US011040813B2

(12) United States Patent
Goglio et al.

(10) Patent No.: US 11,040,813 B2
(45) Date of Patent: Jun. 22, 2021

(54) HERMETICALLY SEALED FLAT CONTAINERS FOR CONTAINING LOOSE MATERIALS IN LIQUID, PASTY, GRANULAR, OR POWDER FORM

(71) Applicant: Goglio S.p.A., Milan (IT)

(72) Inventors: Franco Goglio, Milan (IT); Roberto Galbasini, Milan (IT); Andrea Maria Danelli, Milan (IT)

(73) Assignee: GOGLIO S.P.A., Milan (IT)

( * ) Notice: Subject to any disclaimer, the term of this patent is extended or adjusted under 35 U.S.C. 154(b) by 0 days.

(21) Appl. No.: 16/771,654

(22) PCT Filed: Nov. 22, 2018

(86) PCT No.: PCT/IB2018/059218
§ 371 (c)(1),
(2) Date: Jun. 10, 2020

(87) PCT Pub. No.: WO2019/116127
PCT Pub. Date: Jun. 20, 2019

(65) Prior Publication Data

US 2020/0361683 A1 Nov. 19, 2020

(30) Foreign Application Priority Data

Dec. 11, 2017 (IT) ..... 102017000142151

(51) Int. Cl.
*B65D 75/00* (2006.01)
*B65D 33/02* (2006.01)
*B65D 33/14* (2006.01)

(52) U.S. Cl.
CPC ..... *B65D 75/008* (2013.01); *B65D 33/02* (2013.01); *B65D 33/14* (2013.01)

(58) Field of Classification Search
CPC ..... B65D 75/008; B65D 33/02; B65D 33/14
(Continued)

(56) References Cited

U.S. PATENT DOCUMENTS 3,003,681 A * 10/1961 Orsini ..... B23Q 7/04 383/121
3,063,614 A * 11/1962 Orsini ..... B65D 75/008 383/119

(Continued)

FOREIGN PATENT DOCUMENTS

EP 1947023 A2 7/2008
EP 2017193 B1 12/2010

(Continued)

OTHER PUBLICATIONS

International Search Report and Written Opinion in corresponding International Application No. PCT/IB2018/059218 dated Feb. 26, 2019, 12 pages.

*Primary Examiner* — Jes F Pascua
(74) *Attorney, Agent, or Firm* — MH2 Technology Law Group LLP

(57) ABSTRACT

A hermetically sealed flat container for containing loose materials may include: first and second flexible sheet elements, having polygonal shape, which are coupled together by welds formed along a perimeter of their polygonal shape, to define a volume for containing the materials. The perimeter may define a plurality of edges, one edge forming a bearing edge for the container to rest upon a base. The bearing edge may progressively reduce its transverse dimensions toward one end such that, when the bearing edge rests on the base, a weight-force component of the materials applied to the bearing edge causes a reaction that causes the bearing edge to retract into the volume and imparts vertical stability to the container. The container further comprises a strip of stiffening material attached to the first and second flexible sheet elements, the strip spaced from the bearing edge except for end portions of the strip.

9 Claims, 4 Drawing Sheets

(58) Field of Classification Search
USPC ..... 383/104
See application file for complete search history.

(56) References Cited

U.S. PATENT DOCUMENTS

| | | | | | |
|---|---|---|---|---|---|
| 3,337,117 | A * | 8/1967 | Lehmacher | B65D 31/147 | 383/37 |
| 6,546,669 | B2 * | 4/2003 | Weder | B65D 75/008 | 47/72 |
| 6,560,924 | B1 * | 5/2003 | Weder | B65D 75/008 | 47/72 |
| 2004/0031195 | A1 * | 2/2004 | Weder | A47G 7/085 | 47/72 |
| 2004/0052437 | A1 * | 3/2004 | Tobolka | B65D 75/008 | 383/104 |
| 2004/0136620 | A1 * | 7/2004 | Wilson | B65D 75/008 | 383/104 |
| 2007/0297701 | A1 * | 12/2007 | Engel | B65D 33/02 | 383/104 |

FOREIGN PATENT DOCUMENTS

| | | | | |
|---|---|---|---|---|
| EP | 2050688 | B1 | 1/2020 | |
| GB | 1109861 | | 4/1968 | |
| JP | H05-094139 | U | 12/1993 | |
| WO | WO-03064273 | A1 * | 8/2003 | B29C 65/14 |

* cited by examiner

HERMETICALLY SEALED FLAT CONTAINERS FOR CONTAINING LOOSE MATERIALS IN LIQUID, PASTY, GRANULAR, OR POWDER FORM

CROSS-REFERENCE TO RELATED APPLICATION(S)

This application is a national stage entry from International Application No. PCT/IB2018/059218, filed on Nov. 22, 2018, in the Receiving Office ("RO/IB") of the international Bureau of the World Intellectual Property Organization ("WIPO"), and published as International Publication No. WO 2019/116127 A1 on Jun. 20, 2019; International Application No. PCT11B2018/059218 claims priority from Italian Patent Application No. 102017000142151, filed on Dec. 11, 2017, in the Italian Patent and. Trademark Office ("IPTO"), the entire contents of all of which are incorporated herein by reference.

FIELD OF THE INVENTION

The present patent application relates to a flat container for packaging loose materials in liquid, powder or granular form, adapted to also assume an upright vertical position on one edge thereof, while containing the material as defined in the preamble of claim 1.

Particularly, but without limitation, the aforementioned container is flexible and hermetic and shaped as a bag and, when filled with these materials, it is adapted to move from a flat position to a stable upright vertical position, with one edge resting on a horizontal base, thereby forming a so-called "stand-up bag" or "pillow up bag".

BACKGROUND OF THE INVENTION

"Stand-up" or "pillow up bag" containers generally assume the shape of a bag having a polygonal boundary, preferably a square or rectangular boundary, which comprises a bearing wall, side walls extending from the bearing wall and ending with an upper wall, the latter being opposed to the bearing wall, and is possibly equipped with closing and reopening devices for introducing and dispensing its contents.

Namely, the walls are formed by welding flexible sheet elements. For example, the sheet element that forms the bearing wall is connected by welding along at least part of its perimeter, to the sheet elements that form the side walls of the container, thereby requiring at least three sheet elements to form the structure of the container and hence of the package.

For such containers to be able to take an upright vertical position when filled, the sheet element that forms the bearing wall is designed to be appropriately shaped and folded. Namely, the sheet element is shaped both to act as the bearing edge of the container and to provide support to the container when the latter is in the vertical position. For this purpose, due to its folds, the sheet element of the bearing wall is permanently enclosed in the container.

Containers of the aforementioned type are disclosed, for example, in EP 2050688 and EP 2017193.

Other types stand up containers use a single sheet element which still has folds in the portion that is designed to rest on the base, said folds being configured to be permanently enclosed in the volume of the container to provide stable support for the vertical position.

PRIOR ART PROBLEM

The aforementioned stand up or pillow up containers require a sterilization treatment before being filled with the material intended for sale/consumption, for obvious hygienic reasons. The sterilization treatment is carried out, for instance, by radiation (for example UV, X-ray radiation, etc.) or other similar techniques such as thermal treatments (e.g. with steam, autoclave) or chemical treatments (e.g. with hydrogen peroxide or ethylene oxide), as is known in the art.

Such sterilization treatment must be carried out both in the internal volume of the container (i.e. the volume designed to receive the material) and on the outer surfaces of the side walls as well as the outer surface of the bottom wall.

Nevertheless, in order to ensure a proper sanitizing treatment, namely on the outer surface of the bearing side, special workstations must be arranged along the bag feeding/filling line, for spreading out the bearing side by opening the folds, to thereby also sanitize the corners foamed between the folds.

While this process is usually effective, it still has drawbacks, the most severe thereof is that there is no guarantee that the sanitizing treatment has actually also reached the hidden folds of the bearing edge.

Also, in addition to the special sanitization equipment, further equipment is required for spreading out the folds.

An additional issue with the folded bottom side is its inherent mechanical fragility, i.e. the poor strength of the folds under non-vertical load forces. The folds of the bearing side are designed to support the weight of the container in the vertical position, but they may collapse when the container is laid in the horizontal position or pressed ("flex cracking"). Such fragility is also exhibited during the accidental falls of the bag, for example from a shelf.

The issue of poor strength of the folds in the bearing side becomes more serious as the mass in the volume of the container increases.

JPH0594139U, GB1109861, and EP 1947023 disclose examples of containers as defined in the preamble of claim 1.

OBJECT OF THE PRESENT INVENTION

The object of the invention is to provide a container whose shape can overcome the drawbacks of the prior art as discussed above.

These objects are fulfilled by a hermetically sealed flexible flat container for containing loose materials in liquid, pasty, granular or powder form, which is adapted to also assume a stable upright vertical position, while containing said materials, when one edge thereof rests on a base, as defined in the following claims.

The present invention can provide a container that may smoothly move from a flat shape when it is filled (or empty) to an upright vertical position on one bearing edge when it is filled with loose material and move back to the flat shape when it is laid on a side surface thereof.

The present invention can provide a container that is formed by laying only two sheet elements one on top of the other and welding them along the sides that form their boundaries, which affords an apparent advantage in the sanitization process, due to the lack of folds in the bottom side.

Furthermore, the present invention allows easier transportation of the containers, which may be carried in the horizontal position, as the container has no fragile folds in the bearing edge.

Also, the present invention can provide a container with improved strength, as it has no folds retracted in the internal volume of the container.

The present invention can also provide a container that affords faster heat dissipation as the product therein cools after an autoclave sterilization treatment or hot filling, as it may be also stored in the lying position, thereby increasing the conduction exchange surface, unlike a typical known stand-up container, which almost entirely releases heat by convection.

Finally, the present invention can provide a container whose fabrication requires a smaller amount of material, as only two sheet elements are used.

BRIEF DESCRIPTION OF THE FIGURES

The characteristics and advantages of the present disclosure will appear from the following detailed description of possible practical embodiments thereof, which are shown as non-limiting examples in the drawings, in which.

DETAILED DESCRIPTION

Figure 1A:
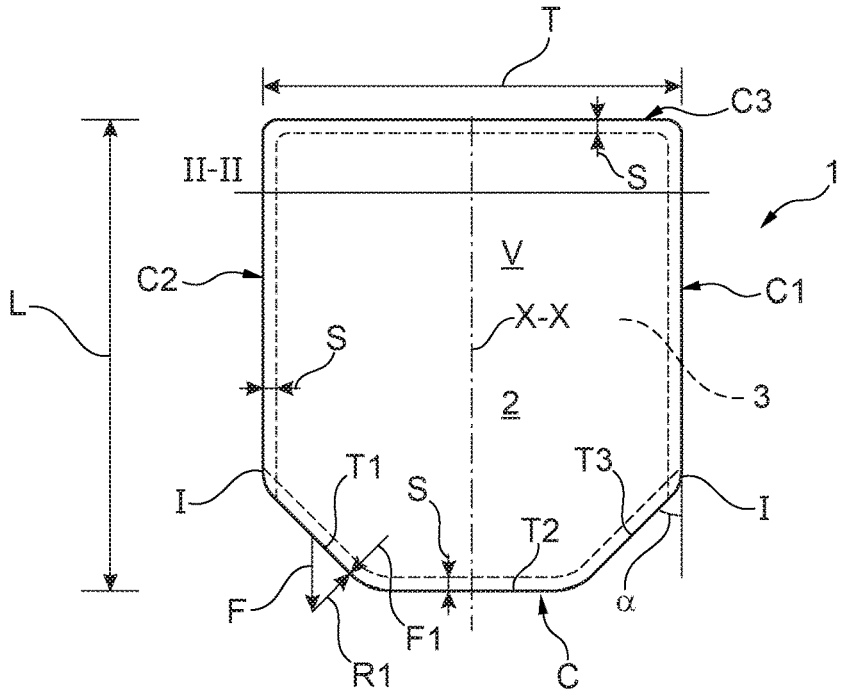
FIG. 1A shows a side view of the container according to a first embodiment, as it lies in a horizontal position.

Even when this is not expressly stated, the individual features as described with reference to the particular embodiments shall be intended as auxiliary to and/or interchangeable with other features described with reference to other exemplary embodiments.

Referring to the accompanying figures, the container of the invention, generally designated by numeral 1, comprises a first polygonal sheet element 2, which is coupled to a second polygonal sheet element 3 by conventional welds S formed along their perimeters.

Such welds define a closed and sealed volume V, which is designed to be filled with loose material to be packaged, such as flour, cereals or liquid or pasty juices, as is known in the art.

It shall be noted that the volume that can be obtained with the container 1 of the present disclosure may vary according to specific needs may range from 0.25 L, to 25 L.

The materials of the sheet elements 2 and 3 may have the same composition or different compositions as long as welding affinity therebetween is ensured.

The sheet elements 2 and 3 may be formed one or more layers i.e. in a multilayer configuration, each layer having its own properties and technical specifications according to the type of material to be preserved. For example, the sheet elements 2 and 3 may comprise a plurality of layers of different materials, possibly with a lining therebetween for imparting greater strength to the sheet elements.

The sheet elements 2 and 3 define respective side surfaces of the container 1.

In one aspect, the perimeter that is formed when the sheet elements 2 and 3 have been coupled defines a plurality of edges C, C1, C2, C3.

One edge of the edges C, C1, C2, C3 identified by the perimeter of the container 1 is a bearing edge C. Such edge acts as a bearing side of the container when the latter is placed on a base (not shown), such as a shelf or a walkway surface for the container 1.

Figure 1B:
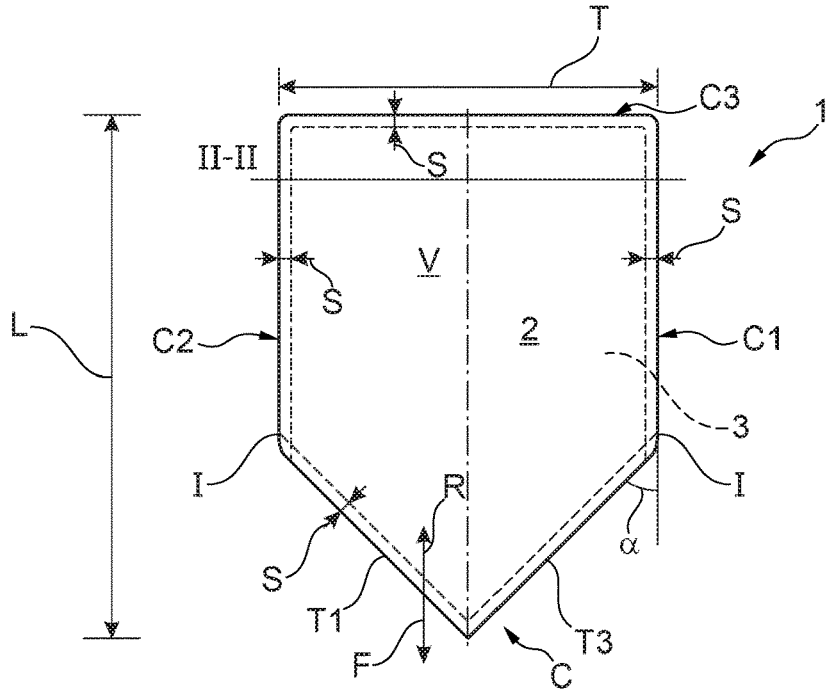
FIG. 1B shows a side view of the container according to a second embodiment, as it lies in a horizontal position.
Figure 2:
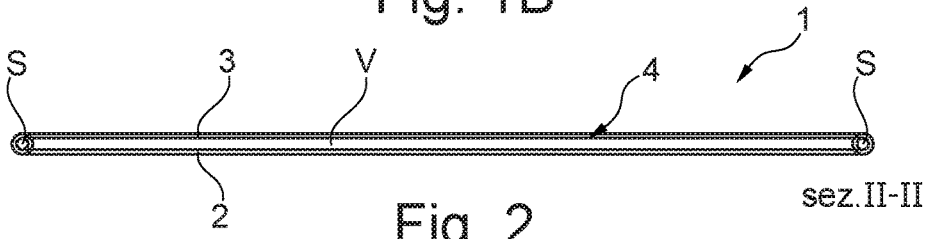
FIG. 2 shows a cross sectional view of the container of FIG. 1A or 1B, as taken along the line II-II of FIG. 1A or 1B.
Figure 4A:
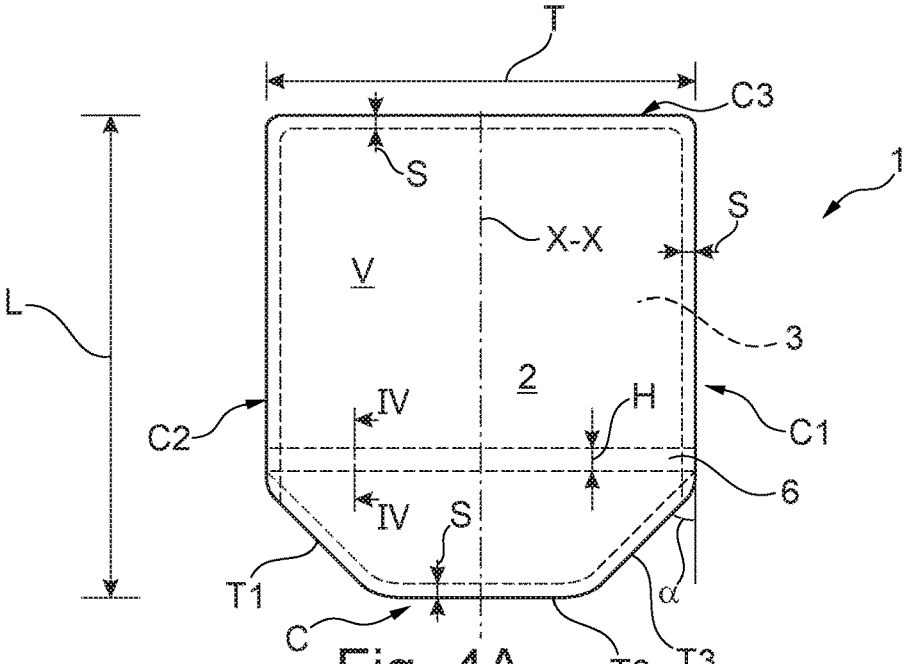
FIG. 4A shows a side view of the structure of the container according to an embodiment thereof other than that of FIG. 1A, as it lies in a horizontal position.

In one embodiment, also referring to FIGS. 1A, 1B and 4A, all the edges C1, C2, C3 extend as straight lines connected to each other to define the perimeter.

Figure 4B:
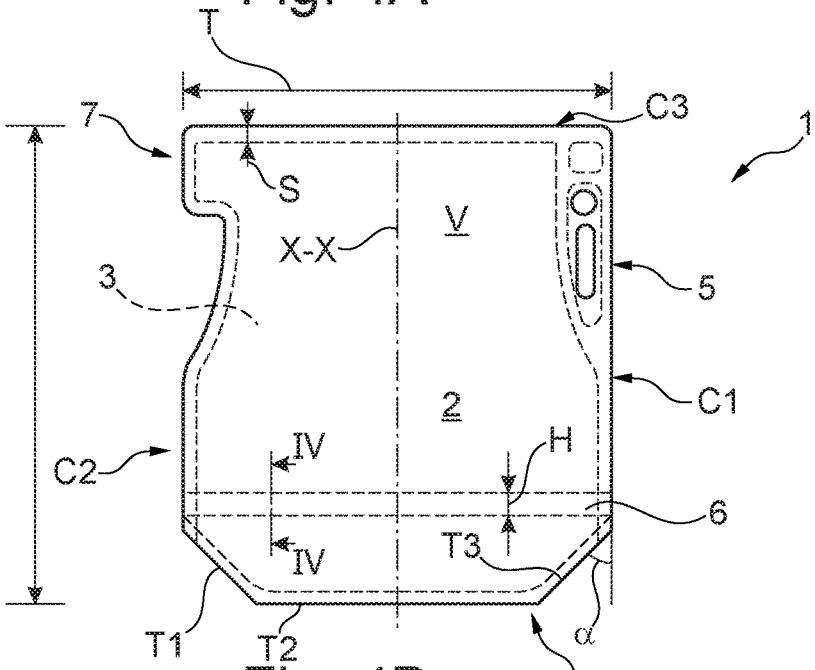
FIG. 4B shows a side view of the structure of the container according to an embodiment thereof other than that of FIG. 1A, as it lies in a horizontal position.

In one embodiment, also referring to FIG. 4B, the edges C1 and C3 extend as straight lines whereas the edge C2 has a mixed straight/curvilinear configuration, and they are connected to each other to define the perimeter.

In one embodiment, the bearing edge C extends from two edges C1, C2, defines with each of them a respective intersection point I, and terminates outside the container 1 with a free end.

Namely, the bearing edge C has a progressive decrease of its transverse dimensions toward its end, by tapering with a taper angle $\alpha$, relative to a vertical axis X-X.

In other words, the bearing edge C has a profile/section whose extension has a gradual inclined restriction (relative to the axis X-X) with a taper angle $\alpha$, starting from the aforementioned intersection points I.

As used herein, the term vertical axis X-X is intended to designate an axis that extends in a main direction of extension of the container 1. This axis X-X can be identified both when the container 1 is in a lying position and when it is in a vertical position and may coincide with the axis of symmetry in certain embodiments of the container.

It shall be noted that, due to the taper of the edge C, the component F1 of the weight force F of the material in the container 1 applied on it, will cause a reaction R1, when the bearing edge C rests on the base, that has the same intensity as the component F1, directed toward the interior of the container 1, thereby causing the bearing edge C to retract into the volume V and imparting stability to the container 1 along the vertical axis X-X.

Figure 3:
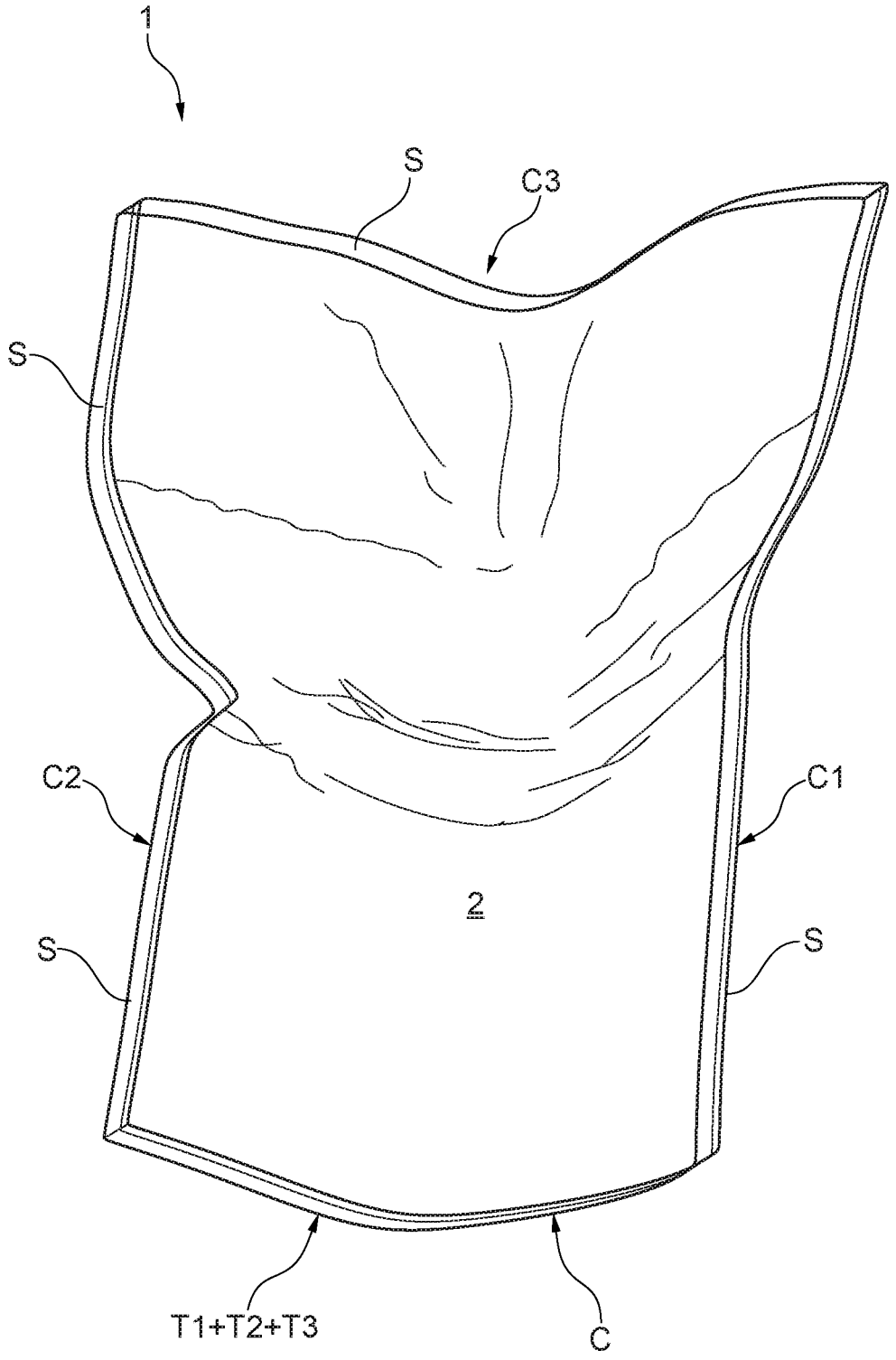
FIG. 3 shows a schematic perspective view of the container of the first or second embodiment, when it has been sealed with loose material therein, and rests in an upright vertical state on one bearing edge thereof.
Figure 5:
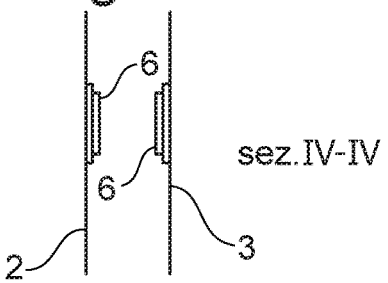
FIG. 5 shows a cross sectional view of the container of FIG. 4A or 4B, as taken along the line IV-IV of FIG. 4A or 4B.
Figure 6:
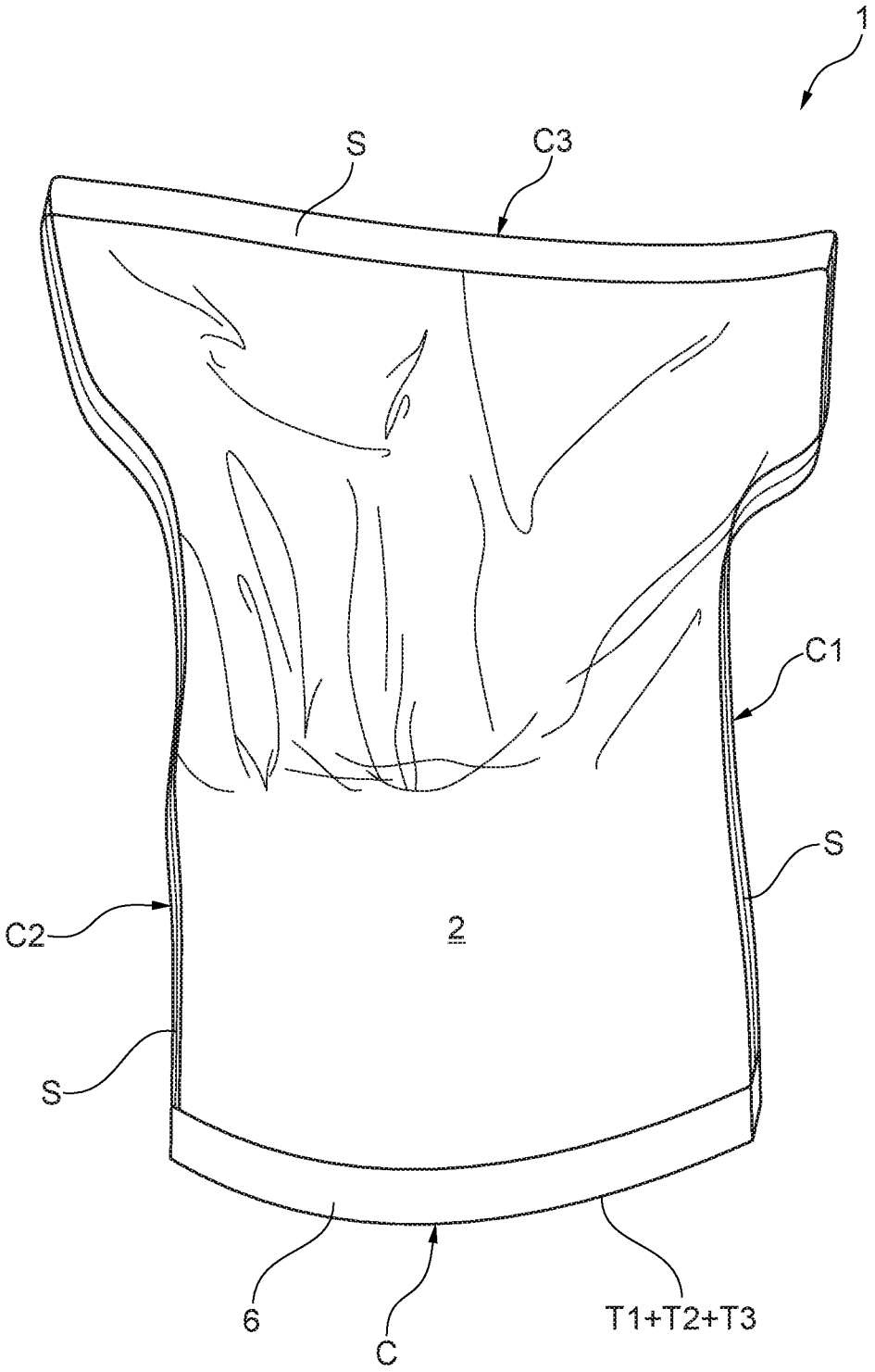
FIG. 6 shows a schematic perspective view of the container of the alternative embodiment of FIG. 4A, when it has been sealed with loose material therein, and rests in an upright vertical state on its base end.

Therefore, the following advantages are achieved:

when the container 1 is filled with the aforementioned materials, it rests on one of its side walls identified by the outwardly facing surfaces of the respective sheet elements 2 and 3, and has a flat configuration i.e. has a bag shape, as the tapered bearing edge C is external to the volume V of the container 1 (FIGS. 1A, 1B and 4A);

when the container 1, filled with the aforementioned materials, is in a vertical position along the axis X-X, with the tapered bearing edge C resting on the base, it has the shape of a "stand-up bag" or "pillow up bag", as the tapered bearing edge C is retracted in the container 1 (FIGS. 3 and 5).

Namely, the container 1 can move from the vertical position to the horizontal position, which means that the taper of the edge C can smoothly move from the inside to the outside of the container 1, because the bearing edge C has no folds or shapes that would force the bearing edge C to an irreversible configuration.

Such possible movement is also facilitated by the fact that the two sheet elements 2 and 3 are made of flexible materials.

These features afford easier handling of the container 1 as well as stacking thereof even when it is filled in a horizontal lying position, i.e. lying on the side walls.

Furthermore, the configuration of a container with two sheet elements 2 and 3 one on top of the other allows the sanitization treatment to be carried out on the outer surfaces of the two overlapping sheet elements 2 and 3 without using machines for spreading them out, as the container 2 has a flat shape before filling.

Thus, the container 1 has the advantage of allowing effective sanitization of the package when the latter is formed and sealed by the welds S all along its outer surface because, while it is able to assume a vertical position, it has no recesses that might hinder the action of sanitization means.

On the other hand, the interior of the container 1 shall be sanitized, before filling, using conventional methods, i.e. by opening a mouthpiece 4, introducing therein the conventional spray device of the sanitization means, and later removing it.

In one aspect, the taper angle $\alpha$ ranges from 30° to 65°, and is preferably 45°.

Namely, according to a preferred embodiment, the bearing edge C comprises at least two sides (FIG. 1B), preferably three sides (FIG. 1A), T1, T2, T3, transverse to each other and forming an angle $\alpha$ with the vertical axis X-X.

In this embodiment, the component F1 of the weight force F of the material in the container 1 is applied to these sides T1, T2, T3 and causes a reaction R1, when the bearing edge C rests on the base, that has the same intensity as the component F1, directed toward the interior of the container 1, thereby imparting stability to the container 1 along the vertical axis X-X.

In other words, the vertical stability of the container 1 along the axis X-X is obtained because, when the container 1 contacts the supporting base, the transverse sides T1, T2, T3 of the bearing edge C of the container 1, due to the component R1 retract into the container 1, thereby imparting vertical stability thereto.

Referring now to FIGS. 4A, 4B, 5 and 6, according to an alternative embodiment of the invention, the container I comprises a strip 6 of reinforcing material at the intersection points I between the opposed sides C1 and C2 and their respective transverse sides T1 and T3, which is stably attached to the sheet elements 2 and 3, inside the container 1, as shown in FIG. 4B, or, alternatively, outside it.

Such reinforcing strip 6, which may also be made of paper material instead of plastic, is arranged proximate to the base surface when the package, with the loose material filled therein, is placed in the vertical position with the bearing edge C resting on the base surface.

Referring now to FIG. 5, it shall be noted that the reinforcing strip 6 is applied to the sheet elements 2 and 3 by heat or ultrasonic welding or glued, depending on the material with which it is formed.

This strip 6 of reinforcing material has a linear extent H ranging from 3% to 15%, preferably 5%, the linear extent L of the container 1.

Referring now to the particular embodiments as shown in the annexed figures, FIGS. 1A, 4A and 4B show that the bearing edge C comprises three sides T1, T2, T3, transverse to each other, whereof two transverse sides T1, T3 form an angle $\alpha$ relative to the vertical axis X-X of the container 1 and the other transverse side T2 is disposed perpendicular to the vertical axis X-X to be intermediate between the first two transverse sides T1, T3. In other words, the transverse side T2 is intermediate between the first two transverse sides T1, T3.

Conversely, in FIG. 1B the bearing edge C only comprises two sides T1, T3, transverse to each other, and the third side orthogonal to the axis X-X, i.e. the side T2, is missing.

In the embodiments as disclosed herein, the two sides T1, T3 may be arranged with a respective, preferably identical, taper angle $\alpha$ relative to the vertical axis X-X.

In both embodiments with three transverse sides (FIG. 1A) and two transverse sides (FIG. 1B) the weight force F acts on all the sides to retract the bearing edge C into the internal volume of the container 1 and to extract them when the container moves from the vertical position to the horizontal position.

In the embodiments as shown in the annexed figures the shape of the perimeter of the container 1 is substantially rectangular, with two opposed longer edges C1 and C2 and a shorter edge C3 opposite to the bearing C.

It shall be particularly noted in these embodiments that each of the at least two transverse sides T1, T3 continuously extend a respective longer edge C1, C2 to form with each opposed edge an intersection I, having an intersection angle equal to the angle $\alpha$, whereas (in the embodiment with three sides forming the bearing edge C) the intermediate side T2 is transverse, at 90°, to the vertical axis X-X and is the first side to contact the base.

It shall be further noted in the embodiments of the figures that the edge C3 is, for example, the edge that contains the mouthpiece 4 open toward the volume V formed between the elements 2 and 3 upon overlapped coupling thereof. In this embodiment, once the container 1 has been filled, it is sealed at the edge C3 by closing the mouthpiece 4 with conventional local weld S as shown for example in FIG. 3.

It shall be noted that the linear extent of the transverse sides T1 and T3 ranges from 15% to 30%, and is preferably 20%, the length L of the container 1 (when taken parallel to the vertical axis X-X), while the linear extent of the side T2 perpendicular to the axis X-X ranges from 30% to 60%, and is preferably 50% the width T (when taken perpendicular to the vertical axis X-X) of the container 1.

It shall be understood that the container of the invention may include various auxiliary conventional devices, such as those as shown in FIG. 4B, i.e. handles 5 and/or pourers 7, with respective closure systems such as caps or "tin ties".

Concerning fabrication, the container of the invention may be fabricated in the usual automatic "bag making" lines from at least one coil of sheet material.

Those skilled in the art will obviously appreciate that a number of changes and variants as described above may be made to fulfill particular requirements, without departure from the scope of the invention, as defined in the following claims.

The invention claimed is:

1. A hermetically sealed flat container for containing loose materials in liquid, pasty, granular, or powder form, which is adapted to also assume a stable upright vertical position, while containing the loose materials, when one edge thereof rests on a base, the container comprising:

a first flexible sheet element having a polygonal shape, which lies over a second flexible sheet element having a polygonal shape, the first and second flexible sheet elements being coupled together by welds formed along a perimeter of their polygonal shape, to thereby define a volume for containing the loose materials;

wherein the perimeter defines a plurality of edges, one of the edges forming a bearing edge for the container to rest upon the base, wherein the bearing edge progressively reduces its transverse dimensions toward one end thereof with a taper angle with respect to a vertical axis, such that, when the bearing edge rests on the base, a component of a weight force of the loose materials contained in the container applied to the bearing edge causes a reaction that has a same intensity as the component of the weight force, but directed toward an interior of the container, thereby causing the bearing edge to retract into the volume and imparting vertical stability to the container, wherein the bearing edge comprises at least two mutually transverse sides, which are inclined with a respective one of the taper angle with respect to the vertical axis of the container, such that when the bearing edge rests on the base, the component of the weight force of the loose materials contained in the container, applied to the at least two mutually transverse sides will cause the reaction that has the same intensity as the component of the weight force, but directed toward the interior of the container, thereby imparting stability to the container along the vertical axis, wherein the plurality of edges comprises:

at least two opposite edges extending a parallel to the vertical axis; and at least one edge transverse to the vertical axis and opposite to the bearing edge;

wherein each of the at least two mutually transverse sides is continuous with a respective one of the at least two opposite edges, and forms an intersection with a same angle as the taper angle with each of the at least two opposite edges, and wherein the container further comprises a strip of stiffening material attached to the first and second flexible sheet elements, the strip having end portions adjacent to the angled intersection between the opposite edges and the mutually transverse sides of the perimeter of the container, and the strip being spaced from the bearing edge except for the end portions.

2. The container of claim 1, wherein the bearing edge comprises three mutually transverse sides, which include two transverse sides, forming the taper angle with respect to the vertical axis, and another transverse side perpendicular to the vertical axis, thereby intervening between the first two transverse sides.

3. The container of claim 1, wherein the taper angle ranges from 30° to 65°.

4. The container of claim 1, wherein the taper angle is 45°.

5. The container of claim 1, wherein the edge opposite to the bearing edge is parallel to the bearing edge.

6. The container of claim 1, wherein the at least two opposite edges have a greater linear dimension than the bearing edge and the edge opposite to the bearing edge.

7. The container of claim 1, wherein the polygonal shapes of the first and second flexible sheet elements are identical.

8. The container of claim 1, wherein the first and second flexible sheet elements have identical compositions.

9. The container of claim 1, wherein the first and second flexible sheet elements have different compositions from each other, but have affinity for welding.

* * * * *